US007784489B2

(12) United States Patent
Paulin et al.

(10) Patent No.: US 7,784,489 B2
(45) Date of Patent: Aug. 31, 2010

(54) CHECK VALVE FOR A SELF-PRIMING PUMP

(75) Inventors: Greg Paulin, Alpine, UT (US); James G. Shaw, Draper, UT (US); James C. Harmon, Salt Lake City, UT (US); James Northrup, Draper, UT (US)

(73) Assignee: EnviroTech Pumpsystems, Inc., Salt Lake City, UT (US)

( * ) Notice: Subject to any disclaimer, the term of this patent is extended or adjusted under 35 U.S.C. 154(b) by 227 days.

(21) Appl. No.: 11/501,478

(22) Filed: Aug. 9, 2006

(65) Prior Publication Data

US 2007/0036665 A1 Feb. 15, 2007

Related U.S. Application Data

(60) Provisional application No. 60/707,392, filed on Aug. 11, 2005.

(51) Int. Cl.
*F16K 15/03* (2006.01)

(52) U.S. Cl. ..... 137/527.2; 415/147

(58) Field of Classification Search ..... 137/15.18, 137/527.2, 269.5, 527, 527.4, 527.6; 417/435; 415/113, 147, 200, 62; 604/174; 83/768
See application file for complete search history.

(56) References Cited

U.S. PATENT DOCUMENTS 1,982,189 A 11/1934 Anderson
2,386,485 A * 10/1945 Longenecker ..... 415/116
2,923,317 A 2/1960 Mcinerney
3,247,801 A * 4/1966 Conery ..... 415/147
3,279,386 A * 10/1966 Rupp et al. ..... 415/147
3,776,659 A * 12/1973 Coon, Jr. ..... 415/200
4,202,654 A * 5/1980 Marlow ..... 415/113
4,842,014 A * 6/1989 Strelow et al. ..... 137/527.2
5,056,548 A * 10/1991 Mills ..... 137/15.18
5,334,001 A 8/1994 Williams
6,050,293 A 4/2000 Lin et al.
6,665,107 B2 * 12/2003 Forgette et al. ..... 359/267
6,887,034 B2 5/2005 Mesiter et al.
7,152,622 B2 * 12/2006 Scaramucci et al. ..... 137/527.2

OTHER PUBLICATIONS

The Gorman-Rupp Company T Series® http://ww.grpumps.com/products~action~display~id~166~level~~kind~~kid~.asp, Oct. 30, 2006.

* cited by examiner

*Primary Examiner*—John Rivell
*Assistant Examiner*—Macade Brown
(74) *Attorney, Agent, or Firm*—Morriss O'Bryant Compagni

(57) ABSTRACT

A check valve of the flapper type structured for use in a self-primer pump is structured for attachment to the pump casing in a manner that facilitates servicing of the check valve, and includes securement means that are positioned external to the casing and a flapper that is located through an opening of the casing in a manner that enables the servicing of the valve without dropping the flapper or the hardware into the interior of the pump.

7 Claims, 4 Drawing Sheets

CHECK VALVE FOR A SELF-PRIMING PUMP

CROSS-REFERENCE TO RELATED APPLICATION

This application is a non-provisional application claiming priority to provisional patent application Ser. No. 60/707,392 filed Aug. 11, 2005.

BACKGROUND OF THE INVENTION

1. Field of the Invention

This invention relates to self-priming centrifugal pumps which are used to process fluids that usually contain solids. Specifically, this invention relates to providing an improved check valve system for self-priming pumps that facilitates maintenance and repair of the check valve of the pump.

2. Description of Related Art

Self-priming centrifugal pumps are well-known and frequently used in industries where processing fluids with entrained solids is required. Self-primer pumps, also known as trash pumps, are characterized as having a casing which houses a suction chamber and a separation chamber divided by a wall or plenum. An impeller positioned in a volute section of the pump receives fluid from the suction chamber and delivers it by centrifugal action into the separation chamber where it is eventually expelled through an outlet.

Self-primer pumps are further structured with a check valve that is positioned at or adjacent the inlet to the pump. In operation, as fluid enters through the inlet, the check valve remains open, allowing fluid to enter into the suction chamber of the pump. When the pump stops, the check valve will seat against the inlet opening to prevent fluid from leaving the suction chamber of the pump. That is, if the check valve remains open or does not seat properly against the inlet, fluid is siphoned back out of the suction chamber until the siphoning action, or siphon leg, is broken. As a result, the fluid level in the suction chamber is very low making re-priming of the pump very difficult. It is desirable, therefore, to assure that fluid remains in the suction chamber.

In known self-primer pumps, small sized pumps are provided with a flapper-type check valve that incorporates a fabric-type hinge that is molded into the valve. In larger sized pumps, a flapper valve is employed having a metallic hinge because more stresses are placed on the valve, thereby making a fabric-type hinge impractical and too subject to failure. In both types of check valves in known conventional pumps, the means by which the valve is secured to the pump casing or inlet make it very difficult to service the check valve for maintenance or repair. Oftentimes, the check valve or hardware used to secure the check valve to the pump casing or inlet opening is dropped into the interior of the pump, which can be detrimental to pump operation and repair.

It would be advantageous in the art, therefore, to provide a check valve assembly that is easy to secure to the pump casing and is easily accessible for servicing the check valve in maintenance or repair without losing the valve or hardware in the pump.

BRIEF SUMMARY OF THE INVENTION

In accordance with the present invention, a check valve of the flapper type is provided for use in a self-primer pump and is structured for attachment to the pump casing in a manner that facilitates servicing of the check valve. The check valve of the present invention has attachment apparatus that are positioned external to the casing, and the flapper of the check valve is located through an opening of the casing in a manner that enables the servicing or replacement of the valve without dropping the flapper or the hardware into the interior of the pump.

The check valve of the present invention generally comprises a flapper valve most suitably made of elastomeric material and has a molded-in metal hinge. A hinge pin end extends from either end of the metal hinge to provide means for attaching the flapper valve to the pump. The flapper valve is positioned over the check valve inlet and is accessible through an access port for servicing.

The attachment apparatus, otherwise referred to herein as "hardware" for attaching the flapper valve to the pump, are located external to the pump. The structure of the attachment apparatus, and its placement, therefore enable the flapper valve to be attached and serviced by manipulation of the hardware from outside the pump. Further, because the hardware comprising the attachment apparatus is located outside the pump, the hardware is not in danger of dropping into the pump during servicing, as is a common occurrence in prior art pumps. The attachment apparatus generally comprises an attachment member which provides structure for attachment of the flapper valve thereto, the attachment member being accessible from outside the pump.

The pump casing, or check valve housing, is further structured with a supporting ledge which is positioned to retain and support the two hinge pin ends of the flapper valve so that the flapper valve cannot fall into the pump during servicing or replacement. The further advantages of the check valve system of the present invention will be apparent from the detailed description of one exemplar embodiment of the invention as illustrated and described further hereinafter.

BRIEF DESCRIPTION OF THE SEVERAL VIEWS OF THE DRAWINGS

In the drawings, which currently illustrate the best mode for carrying out the invention.

DETAILED DESCRIPTION OF THE INVENTION

Figure 1:
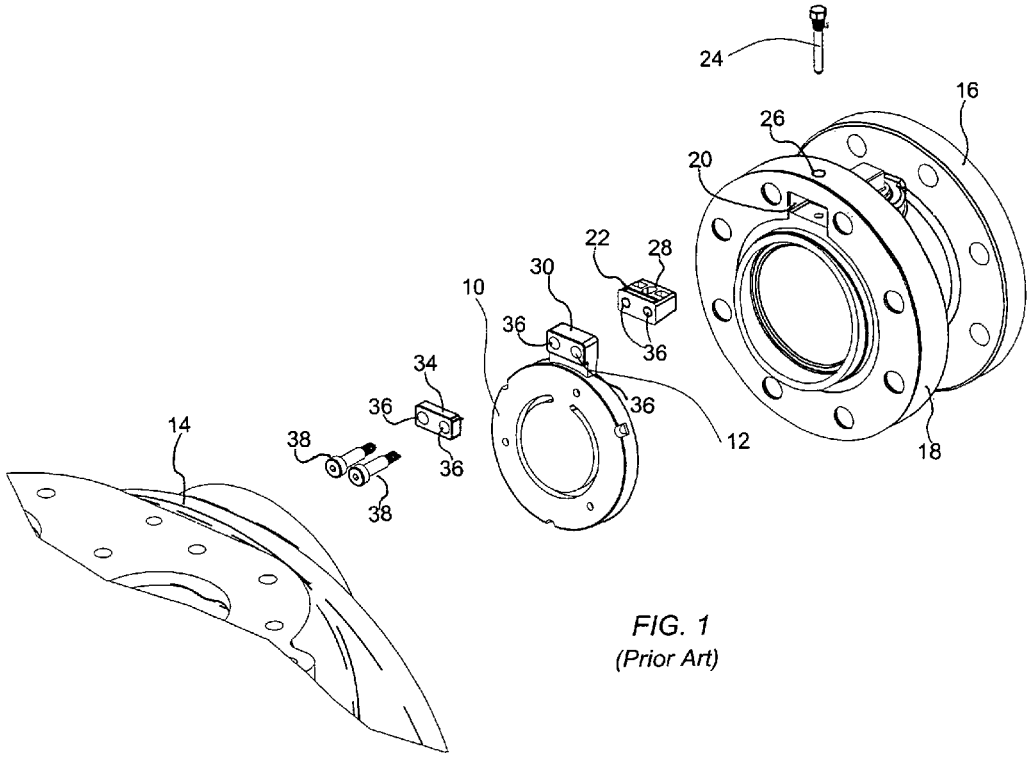
FIG. 1 (Prior Art)
FIG. 1 is an exploded view of the check valve system of prior art self-primer pumps which are smaller in size.
Figure 2:
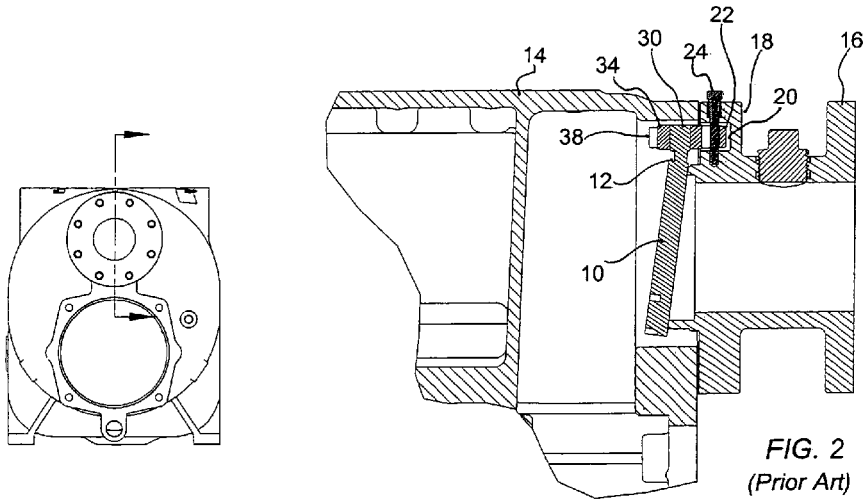
FIG. 2 (Prior Art)
FIG. 2 is a view in cross section of the assembled check valve system of the prior art shown in FIG. 1.

FIGS. 1 and 2 illustrate, for comparative purposes, the structure of small prior art self-primer pumps that employ an elastomeric flapper valve 10 having an embedded steel ring and an elastomeric hinge 12 reinforced with embedded fabric. As best illustrated in FIG. 2, the flapper valve 10 is positioned between the pump casing 14 and an inlet fitting 16 that connects to the pump casing 14 by a rear flange 18. As seen in the perspective view of FIG. 1, the rear flange 18 is structured with an axially-extending opening 20 that is sized to receive a hinge connector 22. The hinge connector 22 is held within the rear flange 18 by a retaining pin 24 that fits through a threaded hole 26 formed through the rear flange 18 and engages a hole 28 in the hinge connector 22.

In attaching the flapper valve 10 to the inlet fitting 16, the hinge head 30 of the flapper valve 10 is positioned adjacent the hinge connector 22 and a hinge plate 34 is thereafter positioned against the hinge head 30 so that holes 36 formed in the hinge plate 34, hinge head 30 and hinge connector 22 are appropriately aligned to receive two securement bolts 38 therethrough. The inlet fitting 16 is then secured to the pump casing 14. Servicing the flapper valve 10 in smaller pumps is relatively easy, as illustrated in FIGS. 1 and 2.

Figure 3:
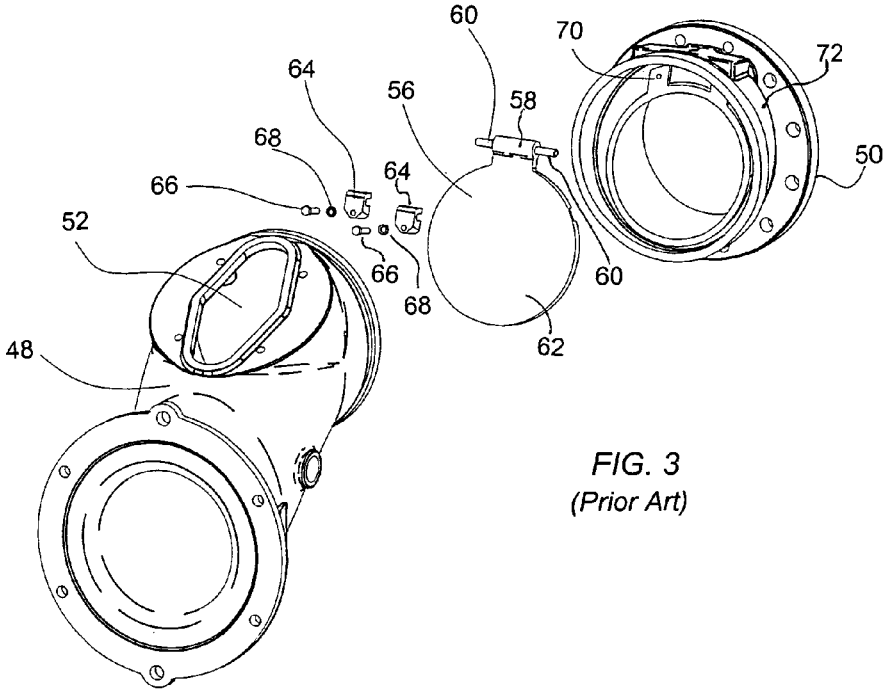
FIG. 3 (Prior Art)
FIG. 3 is an exploded view of a check valve system of a prior art self-primer pump which is of a larger size.
Figure 4:
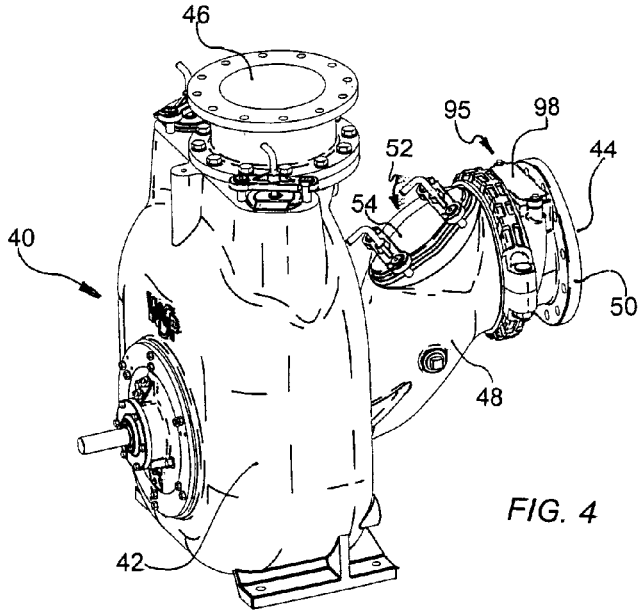
FIG. 4 is a perspective view of a larger size self-primer pump illustrating the external placement of the check valve access port and the external attachment apparatus of the present invention.

By comparison, FIG. 3 illustrates a portion of the larger size self-primer pump in which conventional design and configuration make servicing the flapper valve very difficult. FIG. 4 illustrates the overall construction of a larger size self-primer pump 40 having a casing 42, an inlet 44 and an outlet 46. In larger size pumps, a suction pipe 48 extends from the inlet fitting 50 to the pump casing 42. As described more fully below, an access port 52 having a removable cover 54 is provided in the suction pipe 48 to facilitate servicing the interior of the pump without having to disassemble the suction pipe 48 and inlet 44 from the pump.

FIG. 3 illustrates in an exploded view the assembly of the flapper valve 56 in larger prior art pumps. The flapper valve 56 consists of an internal metal plate 58, having two outwardly extending pins 60, that is embedded in the elastomeric flapper 62. Two pivot caps 64, which are structured to pivotally engage the pins 60 of the flapper valve 56, are secured by bolts 66 and washers 68 to respective holes 70 formed in the check valve body 72 of the pump.

When the flapper valve 56 of prior art pumps requires servicing, such as replacement, the cover 54 of the access port 52 is removed to provide access to the flapper valve 56 through the access port 52. It can be appreciated that attempting to remove the bolts 66 from the pivot caps 64 to remove the flapper valve 56 becomes quite difficult and frequently results in the bolts 66, washers 68, pivot caps 64, and even the flapper valve 62 itself being dropped into the suction pipe 48. The flapper valve 62 and hardware become irretrievable short of disassembling the pump. The present invention seeks to alleviate this problem.

Figure 5:
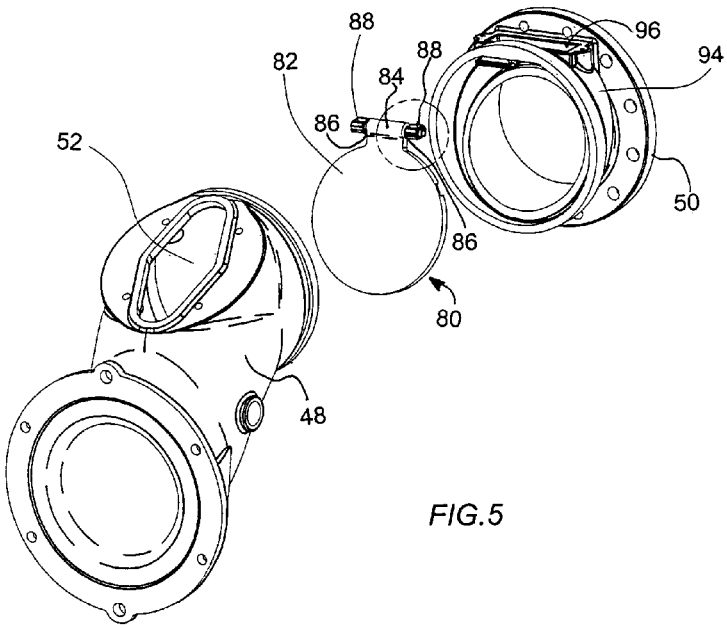
FIG. 5 is an exploded view of the check valve system of the present invention.

FIG. 5 illustrates the check valve assembly of the present invention where, notably, all of the attachment hardware is located externally to the pump casing (e.g., check valve housing), thereby eliminating the possibility of dropping the hardware into the pump. FIG. 4 further illustrates a larger size self-primer pump 40 which is structured with the check valve assembly of the present invention. The check valve 80 comprises an elastomeric flapper 82 having a molded-in metal hinge 84. Two opposing hinge pin ends 86 extend laterally in opposite directions to each other from the hinge 84. While, a single pin may be positioned through the metal hinge 84 to provide the laterally extending pin ends 86, alternatively two separate pin ends 86 may be structured to extend from the hinge 84.

Figure 6:
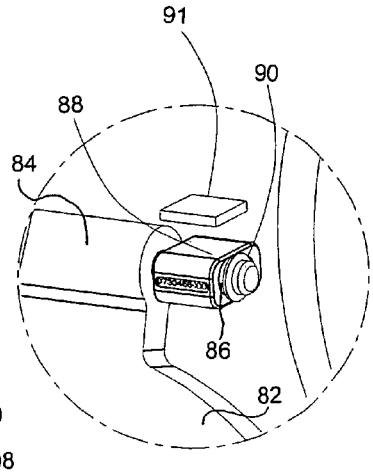
FIG. 6 is a close up view of the structure for attaching the flapper valve to the pump.

As shown more specifically in the enlarged view of FIG. 6, a hinge block 88 is inserted onto each hinge pin end 86 and the hinge block 88 is held in place on the pin end 86 by an end clip 90. For reasons described more fully below, an elastomeric spacer 91 is positioned relative to each hinge block 88 to assure clamping of the flapper 82 in place.

The check valve housing 94 of the present invention is structured to provide support for external positioning of attachment apparatus 95 for attaching the flapper 82 to the check valve housing 94. Thus, the check valve housing 94 is structured with an elongated access opening 96. The attachment apparatus 95 of the invention includes an attachment member 97, here comprising a removable access opening cover 98 that is positionable over the access opening 96 to enclose the access opening 96.

The attachment apparatus further comprises bracket apparatus 99 connected to the attachment member 97, or access opening cover 98. The bracket apparatus 99 is shown in this embodiment as two hinge block brackets 100 that extend downwardly from the access opening cover 98, each hinge block bracket 100 being positioned and structured to engage the respective hinge block 88 with which it is aligned. A spacer 91 is preferably positioned between each of the hinge blocks 88 and the respective hinge block bracket 100 to ensure that the hinge block brackets 100 are tightly secured to the hinge blocks 88 and to provide compensation for depth variances in the access opening cover 98. The spacers 91 may be either attached to or integrally formed with either the hinge blocks 88 or the bracket apparatus 99.

Figure 7:
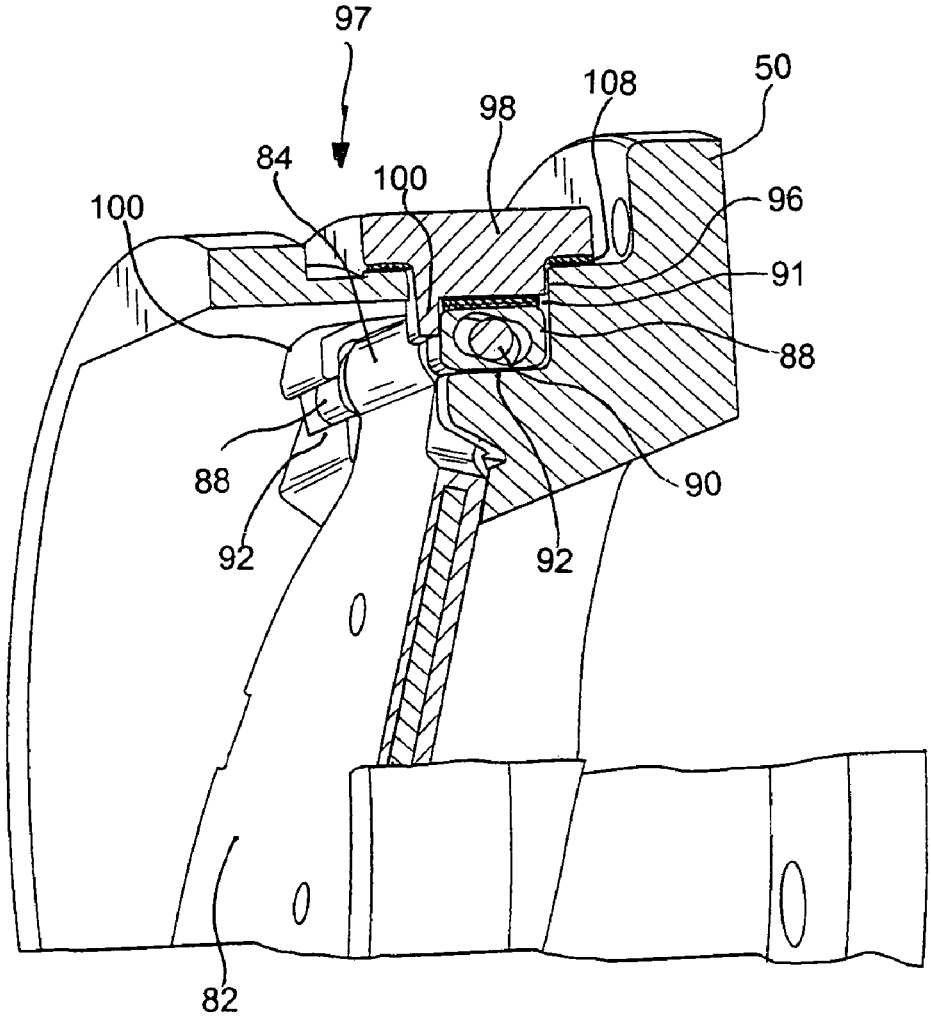
FIG. 7 is a close-up view in partial cross section of the check valve system of the present invention illustrating the external positioning of the securement means.

As best seen in FIG. 7, the check valve housing 94 is structured with two supporting ledges 92 on which the respective hinge blocks 88 are positioned when the check valve 80 is installed in place. When the pump is assembled with the access opening cover 98 secured to the elongated access opening 96 by appropriate screws 104 and washers 106, and with a gasket 108 positioned between the access opening cover 98 and the access opening 96, the downwardly extending hinge block brackets 100 engage the hinge blocks 88 and retain the hinge blocks 88 in position against the supporting ledges 92 and in registration with the check valve housing 94.

When it becomes necessary to replace the check valve 80 after extended use and wear, the access port 52 (FIG. 4) of the suction pipe 48 is opened by removal of the cover 54 to enable one to reach in and take hold of the flapper 82. The access opening cover 98 is then removed by first removing the screws 104 and washers 106. Lifting and removal of the access opening cover 98 concurrently releases the hinge block brackets 100 from their registration against the hinge blocks 88. The check valve 80 remains supported by the supporting ledges 92, and the check valve 80 can then be pulled outwardly away from the supporting ledges 92 to thereby release the hinge blocks 88 from the check valve housing 94. The check valve 80 can then be removed through the suction pipe 48 access port 52. To install the new check valve 80, those steps are reversed.

It can be seen from the foregoing description that positioning of the attachment apparatus, or hardware, outside the pump casing, along with the construction of the check valve and check valve housing, ensures that the check valve can be readily accessed for servicing, and that servicing can take place without the danger of having the hardware or check valve drop into the pump. The structure or configuration of the attachment apparatus for securing the check valve in place, and the configuration and structure of the check valve, may vary and may be adapted to suit the particular construction of a given self-primer pump. Thus, reference herein to details of the structure or configuration of the check valve system of the present invention is by way of example only and not by way of limitation.

What is claimed is:

1. A self-primer pump having a check valve, comprising:

a pump casing;

a check valve inlet;

a flapper valve located within a portion of said pump casing and positioned to register against said check valve inlet, said flapper valve having a hinge and two laterally-extending hinge pin ends for attachment of said flapper valve to an attachment apparatus;

an attachment apparatus for securing said flapper valve to said pump casing, said attachment apparatus comprising an attachment member positioned external to said pump casing and a bracket apparatus extending in a direction from said attachment member into said pump casing to engage and retain said flapper valve in position within and against said pump casing by secure engagement between said attachment apparatus and said flapper valve; and a spacer positioned between each said hinge pin end and said attachment apparatus to provide secure engagement of said hinge pin ends against said pump casing.

2. The self-primer pump of claim 1 wherein said flapper valve further comprises a hinge block positioned on each of said two hinge pin ends to secure said flapper valve to said attachment apparatus.

3. The self-primer pump of claim 2 wherein said spacer is positioned between each said hinge block and said attachment apparatus.

4. The self-primer pump of claim 1 wherein said attachment member is a cover and wherein said two laterally-extending hinge pin ends are positioned for engagement by said bracket apparatus extending from said cover.

5. The self-primer pump of claim 1 wherein said pump casing is structured with a supporting ledge configured to receive and retain said two laterally-extending hinge pin ends therealong.

6. A self-primer pump having a check valve, comprising:

a pump casing;

a check valve inlet;

a flapper valve located within a portion of said pump casing and positioned to register against said check valve inlet, said flapper valve having a hinge and two laterally-extending hinge pin ends with a hinge block positioned on each of said two hinge pin ends for attachment of said flapper valve to an attachment apparatus;

an attachment apparatus for securing said flapper valve to said pump casing, said attachment apparatus comprising an attachment member positioned external to said pump casing and a bracket apparatus extending in a direction from said attachment member into said pump casing to engage and retain said flapper valve in position within and against said pump casing by secure engagement between said attachment apparatus and said flapper valve; and a spacer positioned between each said hinge block and said attachment apparatus.

7. A self-primer pump having a check valve, comprising:

a pump casing;

a check valve inlet;

a flapper valve located within a portion of said pump casing and positioned to register against said check valve inlet, said flapper valve having a hinge;

two laterally-extending hinge pin ends;

a hinge block positioned on each of said two hinge pin ends; and an attachment apparatus for securing said flapper valve to said pump casing, said attachment apparatus comprising an attachment member defining a cover positioned external to said pump casing, and a bracket apparatus extending in a direction from said cover into said pump casing to engage and retain said flapper valve in position within and against said pump casing by secure engagement of said hinge blocks by said bracket apparatus, each said hinge block being spaced from said bracket apparatus by a spacer positioned between each said hinge block and said attachment apparatus.

* * * * *